US005783547A

United States Patent [19]

Wilkinson

[11] Patent Number: 5,783,547

[45] Date of Patent: Jul. 21, 1998

[54] ENZYME GRANULATES

[75] Inventor: Carole Patricia Denise Wilkinson, Brussels, Belgium

[73] Assignee: The Procter & Gamble Company, Cincinnati, Ohio

[21] Appl. No.: 702,463

[22] PCT Filed: Mar. 10, 1995

[86] PCT No.: PCT/US95/02706

§ 371 Date: Sep. 24, 1996

§ 102(e) Date: Sep. 24, 1996

[87] PCT Pub. No.: WO95/25783

PCT Pub. Date: Sep. 28, 1995

[30] Foreign Application Priority Data

Mar. 24, 1994 [EP] European Pat. Off. ..... 94200767

[51] Int. Cl.[6] ..... C11D 3/386; C11D 3/37; C11D 3/10

[52] U.S. Cl. ..... 510/320; 510/321; 510/323; 510/344; 510/353; 510/336; 510/360; 510/361; 510/443; 510/444; 510/452; 510/473; 510/500; 510/417; 510/530

[58] Field of Search ..... 510/320, 321, 510/323, 344, 353, 356, 360, 361, 443, 494, 452, 473, 500, 477, 530

[56] References Cited

U.S. PATENT DOCUMENTS

| | | | |
|---|---|---|---|
| 3,664,961 | 5/1972 | Norris | 252/99 |
| 4,657,693 | 4/1987 | Wise et al. | 252/174.21 |
| 4,686,060 | 8/1987 | Crabtree et al. | 252/90 |
| 4,842,761 | 6/1989 | Rutherford | 252/90 |
| 5,089,167 | 2/1992 | Coyne et al. | 252/186.26 |
| 5,108,646 | 4/1992 | Beerse et al. | 252/174.25 |
| 5,292,446 | 3/1994 | Painter et al. | 252/99 |
| 5,451,341 | 9/1995 | White | 510/299 |
| 5,466,802 | 11/1995 | Panandiker et al. | 510/320 |
| 5,478,502 | 12/1995 | Swift et al. | 510/350 |

*Primary Examiner*—Kery Fries

*Attorney, Agent, or Firm*—Kim William Zerby; T. David Reed; Jacobus C. Rasser

[57] ABSTRACT

The present invention is concerned with granular components comprising an enzyme, specified polymeric binding material, and a mixture of coating components. The granular components are particularly suitable for use in detergent compositions.

1 Claim, No Drawings

ENZYME GRANULATES

The present invention is concerned with granular components comprising enzyme and specified polymeric binding materials. The granular components are particularly suitable for use in detergent compositions.

Background of the Invention

Enzyme encapsulates having a enzymatic activity of about 4 KNPU/g are commercially available today. As well as active enzymes, the encapsulates which are commercially available contain various fillers, binders and coating agents such as sodium chloride, sodium sulphate, methyl cellulose, yellow dextrin and kaolin clay. Representative of the prior art in this field is:

EP206418, published on 30 Dec. 1986, discloses enzyme granulates comprising fillers, binders, granulating agents etc.

The patent discloses encapsulates which comprise enzymes at a level of from 0.5 to 20%, preferably 5% by weight. The encapsulate also comprises (by weight):

1. Fillers at 3% to 97.5%, preferably 45%;
2. Cellulose at 2% to 40%, preferably 25%;
3. Binders at 0% to 10%;
4. Granulating aid at 5% to 40%;

However the fillers and binders that are known in the prior art are principally those which make either no active contribution to the detergent process or which have a low weight effectiveness in the detergent process. Such fillers and binders simply act as an unnecessary "load" on the washing process. Binders disclosed in EP206418 include polyvinyl pyrrolidone (PVP), dextrine, polyvinyl alcohol, hydroxypropyl cellulose, methyl cellulose and carboxy methyl cellulose (CMC). However in todays detergent products, where a high concentrations of active ingredients are required to achieve ever more "compact" products the presence of such fillers and binders is undesirable.

It is an aim of the present invention to provide an enzyme-containing granulate which has a high proportion of detergent-active ingredients.

It is a second aim of the present invention to provide a process for the manufacture of such enzyme-containing granulates.

This has been achieved by the selection of highly efficient binding materials which are also detergent-active ingredients. The binders of the present invention are more weight effective as detergent ingredients than the binders proposed by the prior art, including PVP and CMC.

Summary of the Invention

The granular components of the present invention comprise an enzyme and a polymeric binding material selected from the group consisting of:

- polyamine N-oxide;
- copolymers of N-vinylpyrrolidone and N-vinylimidazole;
- polyvinyloxazolidone;
- polyvinylimidazole;
- polyaspartic acid and its salts;
- polymers and co-polymers of maleic and acrylic acid and their salts;
- and mixtures thereof.

Preferably the polymeric binding material is present at a level of from 0.1% to 25% by weight of the granular component (hereinafter termed the "granulate"), more preferably from 1% to 10%.

The granulate may also comprise one or more fillers such as alkali metal, or alkaline earth metal salts of carbonate, bicarbonate, citrate, phosphate. Citric acid may also be used as the filler.

The granulate may also comprise waxy granulating agents having a melting point between 30° and 100° C., as well as polyvinyl pyrrolidone and carboxymethyl cellulose.

The process of the present invention comprises the steps of:

(a) forming a powder from an enzyme solution and a particulate filler;

(b) granulating said powder with a granulating liquid to form a granulate;

wherein said granulating liquid comprises a polymeric binding material selected from the group consisting of:

- polyamine N-oxide;
- copolymers of N-vinylpyrrolidone and N-vinylimidazole;
- polyvinyloxazolidone;
- polyvinylimidazole;
- polyaspartic acid and its salts;
- polymers and co-polymers of maleic and acrylic acid and their salts;
- and mixtures thereof.

Preferably, the granulating liquid further comprises a nonionic surfactant, or a mixture of nonionic surfactants.

In a particularly preferred process the granulate is mixed with a finely divided particulate flow aid such as sodium aluminosilicate, precipitated or fumed silica, or mixtures thereof.

DETAILED DESCRIPTION OF THE INVENTION

The polymeric binding materials of the present invention are chosen from the following :

- polyamine N-oxide;
- copolymers of N-vinylpyrrolidone and N-vinylimidazole;
- polyvinyloxazolidone;
- polyvinylimidazole;
- polyaspartic acid and its salts;
- polymers and co-polymers of maleic and acrylic acid and their salts;
- and mixtures thereof.

a) Polyamine N-oxide Polymers

The polyamine N-oxide polymers suitable for use contain units having the following structure formula:

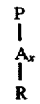

(I)

wherein P is a polymerisable unit, whereto the R—N—O group can be attached to or wherein the R—N—O group forms part of the polymerisable unit or a combination of both.

A is NC(O), C(O)O, C(O), —O—, —S—, —N—; x is 0 or 1;

R are aliphatic, ethoxylated aliphatics, aromatic, heterocyclic or alicyclic groups or any combination thereof whereto the nitrogen of the N—O group can be attached or wherein the nitrogen of the N—O group is part of these groups.

The N—O group can be represented by the following general structures:

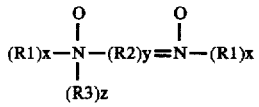

wherein R1, R2, and R3 are aliphatic groups, aromatic, heterocyclic or alicyclic groups or combinations thereof, x or/and y or/and z is 0 or 1 and wherein the nitrogen of the N—O group can be attached or wherein the nitrogen of the N—O group forms part of these groups.

The N—O group can be part of the polymerisable unit (P) or can be attached to the polymeric backbone or a combination of both. Suitable polyamine N-oxides wherein the N—O group forms part of the polymerisable unit comprise polyamine N-oxides wherein R is selected from aliphatic, aromatic, alicyclic or heterocyclic groups. One class of said polyamine N-oxides comprises the group of polyamine N-oxides wherein the nitrogen of the N—O group forms part of the R-group. Preferred polyamine N-oxides are those wherein R is a heterocyclic group such as pyrridine, pyrrole, imidazole, pyrrolidine, piperidine, quinoline, acridine and derivatives thereof. Another class of said polyamine N-oxides comprises the group of polyamine N-oxides wherein the nitrogen of the N—O group is attached to the R-group.

Other suitable polyamine N-oxides are the polyamine oxides whereto the N—O group is attached to the polymerisable unit. Preferred class of these polyamine N-oxides are the polyamine N-oxides having the general formula (I) wherein R is an aromatic, heterocyclic or alicyclic groups wherein the nitrogen of the N—O functional group is part of said R group.

Examples of these classes are polyamine oxides wherein R is a heterocyclic compound such as pyrridine, pyrrole, imidazole and derivatives thereof. Another preferred class of polyamine N-oxides are the polyamine oxides having the general formula (I) wherein R are aromatic, heterocyclic or alicyclic groups wherein the nitrogen of the N—O functional group is attached to said R groups. Examples of these classes are polyamine oxides wherein R groups can be aromatic such as phenyl.

Any polymer backbone can be used as long as the amine oxide polymer formed is water-soluble. Examples of suitable polymeric backbones are polyvinyls, polyalkylenes, polyesters, polyethers, polyamide, polyimides, polyacrylates and mixtures thereof.

The amine N-oxide polymers of the present invention typically have a ratio of amine to the amine N-oxide of 10:1 to 1:1000000. However the amount of amine oxide groups present in the polyamine oxide polymer can be varied by appropriate copolymerization or by appropriate degree of N-oxidation. Preferably, the ratio of amine to amine N-oxide is from 2:3 to 1:1000000. More preferably from 1:4 to 1:1000000, most preferably from 1:7 to 1:1000000. The polymers of the present invention actually encompass random or block copolymers where one monomer type is an amine N-oxide and the other monomer type is either an amine N-oxide or not. The amine oxide unit of the polyamine N-oxides has a PKa<10, preferably PKa<7, more preferred PKa<6. The polyamine oxides can be obtained in almost any degree of polymerisation. The degree of polymerisation is not critical provided the material has the desired water-solubility and dye-suspending power. Typically, the average molecular weight is within the range of 500 to 1000,000; preferably from 1,000 to 50,000, more preferably from 2,000 to 30,000, most preferably from 3,000 to 20,000.

b) Copolymers of N-vinylpyrrolidone and N-vinylimidazole

The N-vinylimidazole N-vinylpyrrolidone polymers used in the present invention have an average molecular weight range from 5,000–1,000,000, preferably from 20,000–200,000. Highly preferred polymers for use in detergent compositions according to the present invention comprise a polymer selected from N-vinylimidazole N-vinylpyrrolidone copolymers wherein said polymer has an average molecular weight range from 5,000 to 50,000 more preferably from 8,000 to 30,000, most preferably from 10,000 to 20,000. The average molecular weight range was determined by light scattering as described in Barth H. G. and Mays J. W. Chemical Analysis Vol 113."Modern Methods of Polymer Characterization".

Highly preferred N-vinylimidazole N-vinylpyrrolidone copolymers have an average molecular weight range from 5,000 to 50,000; more preferably from 8,000 to 30,000; most preferably from 10,000 to 20,000.

The N-vinylimidazole N-vinylpyrrolidone copolymers characterized by having said average molecular weight range provide excellent dye transfer inhibiting properties while not adversely affecting the cleaning performance of detergent compositions formulated therewith. The N-vinylimidazole N-vinylpyrrolidone copolymer of the present invention has a molar ratio of N-vinylimidazole to N-vinylpyrrolidone from 1 to 0.2, more preferably from 0.8 to 0.3, most preferably from 0.6 to 0.4.

c) Polyvinyloxazolidone

The detergent compositions of the present invention may also utilize polyvinylpyrrolidone ("PVP" having an average molecular weight of from The compositions of the present invention may also utilize polyvinyloxazolidone as a binding agent. Said polyvinyloxazolidones have an average molecular weight of from about 2,500 to about 400,000, preferably from about 5,000 to about 200,000, more preferably from about 5,000 to about 50,000, and most preferably from about 5,000 to about 15,000.

d) Polyvinylimidazole

The detergent compositions of the present invention may also utilize polyvinylpyrrolidone ("PVP" having an average molecular weight of from The detergent compositions of the present invention may also utilize polyvinylimidazole as binding agent. Said polyvinylimidazoles have an average about 2,500 to about 400,000, preferably from about 5,000 to about 200,000, more preferably from about 5,000 to about 50,000, and most preferably from about 5,000 to about 15,000.

e) Other Polymers

Polymers which are particularly useful as components of the binder of the present invention include polyaspartate (and polyaspartic acid), polyacrylamides, polyacrylates and various copolymers, such as those of maleic and acrylic acids. Molecular weights for such polymers vary widely but most are within the range of 2,000 to 100,000.

Most preferred are polymeric polycarboxyate builders are set forth in U.S. Pat. No. 3,308,067, Diehl, issued Mar. 7, 1967. Such materials include the water-soluble salts of homo-and copolymers of aliphatic carboxylic acids such as maleic acid, itaconic acid, mesaconic acid, fumaric acid, aconitic acid, citraconic acid and methylenemalonic acid.

Filler Salts

Filler salts, are preferably chosen from those salts which are active detergent ingredients, for example builders such as alkali metal, or alkaline earth metal salts of carbonate, bicarbonate, citrate, phosphate. Citric acid, in particulate form, may also be used as a filler salt in the present invention.

The Enzyme Granulate and a Process for Making It

The enzyme granulate of the present invention has preferably a particle size of from 100 to 1600 micrometers, more preferably from 200 to 800 micrometers, most preferably 300–500 micrometers.

A preferred process for making enzyme granulates of this invention comprises drum granulating an enzyme material, filler salts, a granulation binder, a liquid phase granulating agent, and optionally finely divided cellulose fibers.

The process for the production of enzyme granulates comprises e.g., the introduction into a drum granulator of from 0 to 40% by weight of cellulose in fibrous form from 0.1 to 10% by weight of a binder as herein defined, 0.5% to 20% enzyme or enzyme powder, and 3% to 97.5% filler salt material in an amount which generates the intended enzyme activity in the finished granulate, a liquid phase granulating agent consisting of a waxy substance, as defined herein, and/or water, in an amount of between 5% and 70% by weight, whereby the maximum amount of waxy substance is 40% by weight and the maximum amount of water is 70% by weight, whereby all percentages are referring to the total amount of dry substances, the sequence of the introduction of the different materials being arbitary, except that at least a major part of the granulating agent is introduced after at least a substantial part of the dry substances is introduced in the granulator, whereafter the granulate, if necessary, is dried in a conventional manner, preferably in a fluid bed.

The cellulose in fibrous form can be sawdust, pure, fibrous cellulose, cotton, or other forms of pure or impure fibrous cellulose. Several brands of cellulose in fibrous form are on the market, e.g., CEPO and ARBOCEL. In a publication from Svenska Tramjolsfabrikerna AB, "Cepo Cellulose Powder", it is stated that for Cepo S/20 cellulose the approximate maximum fiber length is 500 micrometers, the approximate average fiber length is 160 micrometers, the approximate maximum fiber width is 50 micrometers and the approximate average fiber width is 30 micrometers. Also, it is stated that CEPO S2/200 cellulose has an approximate maximum fiber length of 150 micrometers, an approximate average fiber length of 50 micrometers, an approximate maximum fiber width of 45 micrometers and an approximate average fiber width of 25 micrometers. Cellulose fibers with these dimensions are very well suited for the purpose of the invention.

The binders used in the process of the present invention are the binders discussed in detail above. Additionally binders conventionally used in the field of granulation with a high melting point or with no melting point at all and of a nonwaxy nature, e.g., polyvinyl pyrrolidone, dextrine, polyvinylalcohol, and cellulose derivates, including for example hydroxypropyl cellulose, methyl cellulose or CMC.

The term "enzyme" as used herein means raw enzyme unless otherwise specified. The term "enzyme powder" means raw enzyme mixed with inorganic salts such as NaCl, carbonate, bicarbonate, citrate, phosphate and, $CaCl_2$. All enzymes can be granulated by means of said process. Preferably, amylases and proteinases are granulated according to the invention. Specific examples are ALCALASE® (a Bacillus licheniformis proteinase), ESPERASE® and SAVINASE® (microbial alcaline proteinases produced according to British Patent No. 1,243,784) and TERMAMYL® (a Bacillus licheniformis amylase). The enzyme can be introduced into the granulator as a predried milled powder or as a solution, for example, a concentrated enzyme solution prepared by ultrafiltration, reverse osmosis or evaporation.

The granulating agent is water and/or a waxy substance. The granulating agent is always used as a liquid phase in the granulation process; the waxy substance if present therefore is either dissolved or dispersed in the water or melted. By a "waxy substance" is understood a "wax" which possesses all of the following characteristics: (1) the melting point is between 30° and 100° C., preferably between 40° and 60° C., (2) the substance is of a tough and not brittle nature, and (3) the substance possesses substantial plasticity at room temperature.

Both water and waxy substance are granulating agents i.e., they are both active during the formation of the granulate; the waxy substance stays as a constituent in the finished granulate, whereas the majority of the water is removed during the drying. Thus, in order to refer all amounts to the finished, dry granulate, all percentages are calculated on the basis of total dry granulate unless otherwise specified, which means that water, one of the granulation agents, is not added to the other constituents when calculating the percentage of water, whereas the waxy substance, the other granulating agent, has to be added to the other dry constituents when calculating the percentage of waxy substance. Examples of waxy substances are polyglycols, fatty alcohols, ethoxylated fatty alcohols, higher fatty acids, mono-,di- and triglycerolesters of higher fatty acids, e.g., glycerol monostearate, alkylarylethoxylates, coconut monoethanolamide, polyhydroxy fatty acid amide.

An illustrative summary of a process used to make an enzyme granulate is:

1. Provide dry enzyme powder, cellulose fillers, filler salt materials and binders.

2. Mix the dry powders of the granulate.

3. Wet the powder mixture with granulating agent, e.g., water or waxy melt.

4. Process the wet powder mixture of Step 3 in a granulating apparatus (rotating knife) until the granulate has the desired size distribution. A cylindrical Loedige type mixer FM103 DIZ (U.S. Pat. No. 3,027,102) can be used in the process for this step. The mixer is equipped with both plough shaped mixers mounted on a horizontal (axial) rotating shaft and a granulating device, consisting of one or more cross knives mounted on a shaft introduced into the mixer through the cylindrical wall in a direction perpendicular to the abovementioned horizontal rotating shaft (i.e., radial of the cylinder).

5. Dry in a fluidized bed the moist granulate of Step 4 until a dryness which satisfies both the requirements of enzyme stability and the requirements of free-flowing properties and mechanical strength. Usually this will correspond to a water content less than 10%, preferably less than 3% and more preferably bone dry. In the instances where the granulating agent is exclusively or principally a waxy substance only cooling may be required.

6. Optionally coating the enzyme granulate with an alkaline buffer salt coating, a waxy or some other compatible substance.

Calcium Present in Granulate and Coating

The enzyme granulate of this invention can be improved if it contains from 40 to 3000 ppm of calcium calculated as calcium chloride. Calcium can be added to the granulate as calcium chloride or calcium sulfate powder in the granulation process or by using water containing a calcium content of 100–500 ppm, preferably 170–300 ppm, calculated as calcium chloride in the water used in the granulation and/or coating process.

Optional Waxy Coating Material

A nonionic waxy material can be applied over the enzyme granulate or over the alkaline buffer salt coated enzyme granulate. The practical levels of optional waxy coating material is up to 57% by weight of the composition, preferably 5–30%. Examples of such waxy coatings are polyethylene glycols, fatty alcohols, ethoxylated fatty alcohols, higher fatty acids, mono-, di- and triglycerolesters of fatty acids, e.g., glycerol monoestearate, alkylarylethoxylates and coconut monoethanolamide. Preferred nonionic waxy substances are $TAE_{22}$ (tallow alcohol condensed with 22 moles of ethylene oxide per mole of alcohol), PEG 1500–8000 (polyethylene glycol of molecular weight 1500–8000) and palmittic acid. Other waxy coating having a melting point of at least 38° C. preferably at least 50° C., can also be used. For example, this waxy coating is melted (50°–70° C.) and is sprayed onto the granulate in a fluidized bed where cool air (15°–30° C.) is applied to solidify the waxy coating.

A preferred final processing step is the coating of the enzyme granulate with a flow aid. Typically the flow aid is a finely divided particulate, especially sodium aluminosilicate.

Particularly preferred flow aids include Zeolite A, Zeolite B, Zeolite X and Zeolite MAP.

EXAMPLES

Example 1

An enzyme powder is produced by spray-drying an enzyme slurry and grinding. The enzyme powder is then granulated in a mixer with the following materials:

| | % by weight |
|---|---|
| Enzyme Powder | 10 |
| Cellulose fibres | 10 |
| Na2CO3 | 30 |
| Copolymer (as 40% solution) | 30 |
| Zeolite A (80% active) | 15 |

The cellulose fibres and sodium carbonate act as fillers. The Zeolite acts as a flow aid or agglomeration aid and the copolymer (which is a copolymer of maleic and acrylic acid) acts as a binder. The granulation process can be carried out batch or continuously in a Loedige® KM or similar type mixer. The operation can be carried out in one or several stages.

The enzyme granulates then pass to a fluid bed dryer, were their moisture content is reduced to 3%.

The granulates are then screened and passed to a two step coating process. Coating is required since the enzyme granulates from the first stage are usually brown in colour. The coating step requires the use of a finely divided white powder and a liquid binder. Here a nonionic surfactant 4% TAE50 (tallow alcohol ethoxylated with an average of 50 moles of EO) is sprayed on to the granulates in a Loedige® KM in followed by dusting with 5% Zeolite A. The process is repeated in the second Loedige® KM. A final coating of 5% PEG 4000 and carboxymethyl cellulose is added in a final costing/drying step in a fluised bed.

The composition (% by weight) of the final granulate was:

| | |
|---|---|
| Enzyme Powder | 10 |
| Cellulose fibres | 10 |
| Na2CO3 | 30 |
| Copolymer (anhydrous) | 12 |
| Zeolite A (anhydrous) | 12 |
| Moisture | 3 |
| Enzyme Coating: | |
| Zeolite A | 10 |
| TAE5O | 8 |
| Peg 4000/CMC | 5 |

The resulting granule contains 87% of detergent ingredients.

Example 2

The following enzyme granulate composition was prepared using the same process as example 1, this time using a 15% solution of poly(4-vinyl pyridine N-oxide) as the binder:

| Enzyme granulate | % by weight |
|---|---|
| Enzyme Powder | 15 |
| Cellulose Fibres | 5 |
| Na2CO3 | 25 |
| Na Citrate | 10 |
| PVNO | 5 |
| Moisture | 2 |
| Zeolite MAP | 15 |
| Coating: | |
| Zeolite MAP | 5 |
| Titanium dioxide | 5 |
| TAE50 L | 8 |
| PEG 4000 | 5 |

The resulting granulate contained 88% of detergent ingredients.

Example 3

The following enzyme granulate composition was prepared in a similar process using polyaspartate solution (30%) as a binder:

| Enzyme granulate | % by weight |
|---|---|
| Enzyme Powder | 15 |
| Cellulose Fibres | 10 |
| Na2CO3 | 30 |
| Polyaspartate | 10 |
| Moisture | 2.5 |
| Zeolite X | 13 |
| Coating: | |
| Zeolite X | 8 |
| Silica | 0.5 |
| GS-Base/AE5 | 6 |
| PEG 4000 | 5 |

I claim:

1. An enzyme-containing granulate comprising:

(a) 0.5% to 20% of an enzyme selected from amylases, proteases, and mixtures thereof;

(b) 0.1% to 25% of polymeric binding material which is a detergent active ingredient selected from the group consisting of polyamine N-oxide, copolymers of N-vinylpyrrolidone and N-vinylimidazole, polyvinyloxazolidone, polyvinylimidazole, polyaspartic acid and its salts, polymers and copolymers of maleic and acylic acid and their salts, and mixtures thereof;

(c) 3% to 97.5% filler salt material which are active detergent ingredients selected from the group consisting of alkali metal or alkaline earth metal salts of carbonate, bicarbonate, citrate, phosphate, citric acid, and mixtures thereof;

and wherein the enzyme-containing granulate comprises a coating selected from the group consisting of coating A which consists of zeolite A, tallow ethoxylated alcohol having an average of 50 ethylene oxide units, polyethylene glycol having a molecular weight of 4,000 and carboxymethyl cellulose, coating B which consists of zeolite MAP, titanium dioxide, tallow ethoxylated alcohol having an average of 50 ethylene oxide units, and polyethylene glycol having a molecular weight of 4,000 and coating C which consists of zeolite x, silica, polyethylene glycol having a molecular weight of 4,000, and an alcohol ethoxylate having an average of 5 moles of ethylene oxide.

* * * * *